United States Patent [19]

Ross

[11] Patent Number: 4,476,607

[45] Date of Patent: Oct. 16, 1984

[54] PORTABLE VACUUM CLEANING DEVICE

[76] Inventor: David Ross, 1 Louisiana Ave., Lakehopatcong, N.J. 07849

[21] Appl. No.: 428,650

[22] Filed: Sep. 30, 1982

[51] Int. Cl.[3] ..... A47L 9/02

[52] U.S. Cl. ..... 15/339; 15/393; 15/402; 15/415 R; 15/415 A; 15/422

[58] Field of Search ..... 15/339, 415 R, 398, 15/402, 396, 393, 415 A, 422

[56] References Cited

U.S. PATENT DOCUMENTS

| | | | |
|---|---|---|---|
| 1,859,132 | 5/1932 | Fechtenburg | 15/402 |
| 2,665,446 | 1/1954 | Gregory | 15/396 |
| 2,818,595 | 1/1958 | Rosewall | 15/415 A X |
| 3,015,336 | 1/1962 | Caples | 15/415 R X |
| 3,384,921 | 5/1968 | Loston | 15/402 |
| 4,374,446 | 2/1983 | Copperman | 15/415 A |
| 4,402,105 | 9/1983 | Garbacik | 15/398 |

FOREIGN PATENT DOCUMENTS

| | | | |
|---|---|---|---|
| 1096006 | 12/1960 | Fed. Rep. of Germany | 15/415 A |
| 1484856 | 5/1967 | France | 15/339 |
| 860882 | 2/1961 | United Kingdom | 15/339 |

*Primary Examiner*—Chris K. Moore
*Attorney, Agent, or Firm*—Eric P. Schellin

[57] ABSTRACT

A lightweight portable vacuum cleaner and attachment nozzle are disclosed which may be readily carried by an operator to vacuum both normally accessible and normally inaccessible areas. The vacuum cleaner comprises an elbow-shaped plastic housing which encloses a filter bag and blower motor. The vacuum is carried under the arm of the operator supported from a strap that goes over the operator's shoulder. A deodorant chamber is mounted to the exhaust screen of the housing, so that exhaust from the blower motor can be used to distribute scented odor over the surface that is being cleaned. In addition, footings are mounted adjacent to the exhaust screen so that proper ventilation is assured for the blower motor. A flexible hose with suction tube is frictionally fitted into an aperture in the vacuum cleaner and thereby delivers suction to the area at which they are directed. A specific attachment nozzle is coupled to a 45° coupling which is coupled to the suction tube. The attachment nozzle is arranged longitudinally to the suction tube thereby permitting the operator to vacuum in a sweeping side-to-side motion. The attachment nozzle comprises a cylindrical plastic tube into which longitudinal slots are cut which direct suction to the area to be cleaned. A closed end of the plastic tube is fitted with a permanent magnet to pick up metal articles. In addition, the attachment nozzle is provided with prongs for loosing material trapped in the fibrous material of carpets.

11 Claims, 6 Drawing Figures

PORTABLE VACUUM CLEANING DEVICE

BACKGROUND OF THE INVENTION

1. Field of the Invention:

The present invention relates to a lightweight portable vacuum cleaner which may be readily carried by the operator. In addition, a specific attachment nozzle is utilized with this vacuum cleaner to further facilitate its flexibility of operation.

In cleaning large office buildings a number of cleaning crews are used which clean the offices after regular business hours. To increase the efficiency of the crews, vacuum cleaners that are highly portable and lightweight are needed so that crews can move from one office to another quickly. Conventional vacuum cleaners which are mounted on rollers or casters have proved cumbersome because of their weight and lack of maneuverability when cleaning a cluttered office. In addition, many areas prove inaccessible to these vacuum cleaners because of their weight and bulkiness, thereby preventing a thorough vacuuming job.

Specific features that can be built into such vacuum cleaners include the use of transparent suction tubes, as illustrated by Cannan, U.S. Pat. No. 3,919,729, and using the exhaust of a vacuum cleaner for delivering foam to the surface to be cleaned, as illustrated by Crener, U.S. Pat. No. 3,633,240.

The attachment nozzles through which the vacuum is applied to the surface to be cleaned have also proven to be clumsy. Attachment nozzles are coupled to the suction tube of a vacuum cleaner and are placed in contact with the surface to be cleaned thereby applying suction to the surface. The attachment nozzles have slots through which the vacuum is applied and these slots are oriented so as to be perpendicular or lateral to the orientation of the suction tube. The operator controls the placement of the attachment nozzle, and thereby the application of the vacuum, by controlling the movement of the suction tube to which the nozzle is coupled. As such, the perpendicular orientation of the slots dictates that the operator must push and pull the vacuum forward and backward to achieve the maximum vacuumed area. Casters and wheels, and even the weighting of the attachment and suction tube further dictate this push and pull movement.

Attachment nozzles has been adapted to facilitate various operations. Swanson et al, U.S. Pat. No. 2,862,224, uses a magnet mounted on a floor surfacing machine to pick up steel particles located on the floor. Scraper brushes have been attached to the attachment nozzles for scraping or moving rug pile so to better effectuate vacuuming. Such devices are illustrated by Riebel, Jr., U.S. Pat. No. 1,990,710, Ego, U.S. Pat. No. 2,879,430, Martinec, U.S. Pat. No. 2,893,048, Jepson et al, U.S. Pat. No. 3,203,023, and Cyphert, U.S. Pat. No. 4,019,218.

The present invention overcomes the above-presented problems by disclosing a operator-carried vacuum cleaner to which is coupled an attachment nozzle specifically adapted for side-to-side movement. The nozzle is light and can be used to readily service normally inaccessible areas. In addition, the nozzle is provided with prongs for dislodging articles entrained in carpeting; and a magnet for picking up metal articles present on the vacuumed surface.

SUMMARY

The present invention comprises an elbow-shaped light-weight vacuum cleaner that is carried by the operator. The elbow-shaped housing outlining the vacuum encases the vacuum blower motor and a filter bag through which air sucked into the housing during vacuuming is filtered. The blower is mounted in the first leg of the elbow and the filter bag is mounted in the second leg of the housing. The vacuum is carried by a strap which is secured to both legs of the elbow and which passes over the shoulder of the operator. The vacuum is then carried under one arm of the operator freeing the operators hands for controlling the suction tube of the vacuum. A flexible hose is frictionally fitted into an aperture on the second leg of the elbow adjacent to the filter bag. The other end of the hose is coupled to a suction tube which is also coupled to the attachment nozzle.

The attachment nozzle comprises a cylindrical tube which is open at one end where it is coupled to the suction tube; and closed at its other end. The vacuum supplied through the suction tube is delivered to the surface to be cleaned by longitudinally extending slots located on one side of the cylindrical tube. The attachment tube is coupled to the suction in a longitudinal fashion whereby the slots are aligned with the suction tube. This unique orientation and construction eliminates the necessity of a push-pull motion as presented in the prior art and permits a side-to-side motion. The operator by controlling the movement of the suction tube would move the nozzle side-to-side in an arcuate fashion to cover large areas, and because of its small size the operator can reach what were until now, inaccessible areas.

The cylindrical tube is also provided with prongs and a magnet at its closed end to facilitate the pickup of articles, especially paper clips, and staples entrained in carpeting. Pickup of paper clips in the office environment has been especially difficult because the paper clip and staples gets tangled in the fiber of the carpet. The prongs are used to work an entrapped paper clip or staples loose after which the magnet can pick up the clip or staples by magnetic attraction. By mounting prongs at the end of the attachment tube the operator no longer has to bend over to release a trapped paper clip and can, by manipulating the nozzle work a paper clip loose, where it may be picked up by the magnet.

Both the attachment nozzle and the suction tube are made of transparent plastic materials because of its light weight and to enable the operator to monitor the flow of materials in the vacuum. The vacuum housing is also formed out of a plastic material because of its light weight.

The vacuum itself may be provided with a deodorant cannister that is connected to the first leg of the elbow so that exhaust from the blower would deliver a deodorant odor or a scented powder throughout the vacuumed area. The first leg is also provided with footings so that the exhaust exit of the blower cannot be placed flush against anything which would not allow for proper ventilation of the motor.

DETAILED DESCRIPTION OF THE PREFERRED EMBODIMENTS

Figure 1:
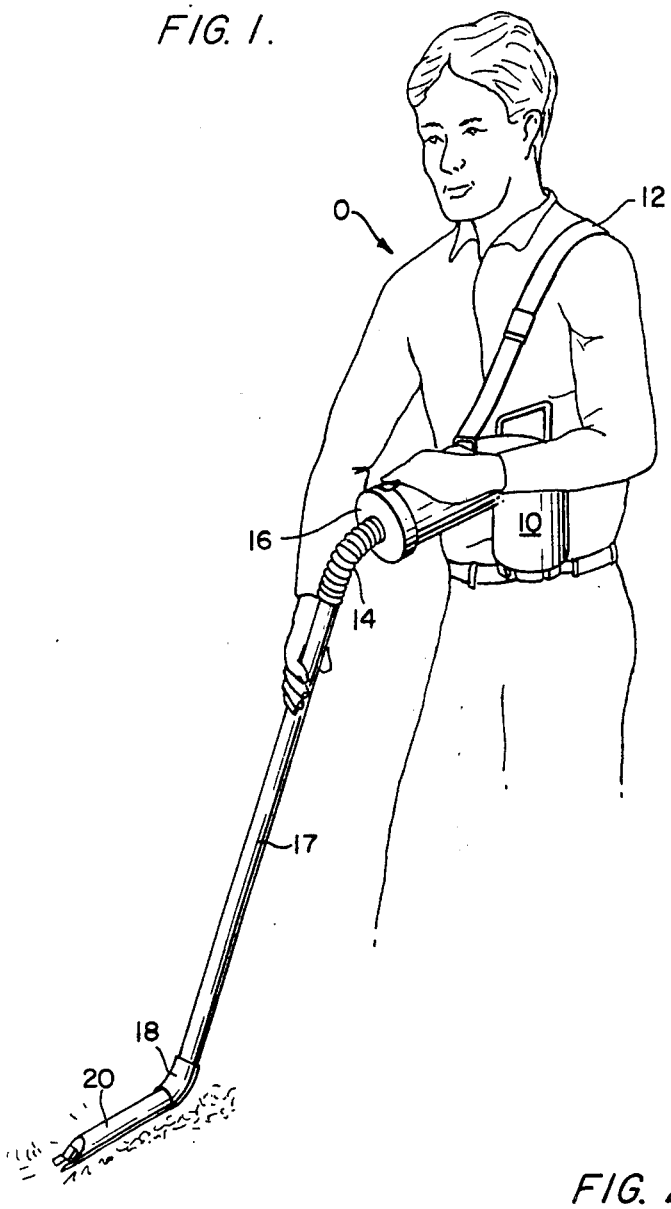
FIG. 1, is a perspective view of an operator using the subject vacuum cleaner.

As illustrated in FIG. 1, operator O carries vacuum cleaner 10 under his arm. Vacuum cleaner 10 is supported by carrying strap 12 which is draped over the operator's shoulder. Flexible hose 14 is coupled to cleaner 10 at an aperture in removable cover 16. The other end of flexible hose 14 is coupled to suction tube 17 which is formed of a transparent plastic. At the other end of suction tube 17 is a 45° coupling 18 to which is coupled attachment nozzle 20. To keep the assembly as light as possible the vacuum cleaner housing, the flexible hose, the suction tube and attachment nozzle are formed out of plastic.

As can be readily understood from the FIG. 1, operator O vacuums the surface to be cleaned by moving attachment nozzle 20 in a sweeping motion from side-to-side instead of a push-pull motion as in conventional vacuum cleaners. These type of motion requires less physical effort than the push-pull motion, because only the lower arm must be moved to complete a sweep whereas in a conventional push-pull motion the total arm, shoulders and upper torso must be moved to complete the motion. In addition, the present attachment nozzle can reach a number of inaccessible places, such as between a desk and a wall and other narrow places that a conventional nozzle attachment cannot reach. Furthermore, because of its lightweight nature, overhead ceiling and wall vents can be vacuumed, and complete walls and ceilings that would ordinarily not be vacuumed by a standard vacuum and nozzle because of their cumbersome nature.

Figure 2:
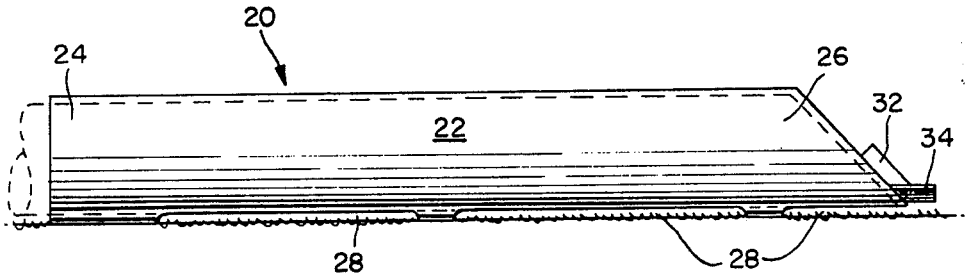
FIG. 2, is a side plan view of the attachment nozzle.
Figure 3:
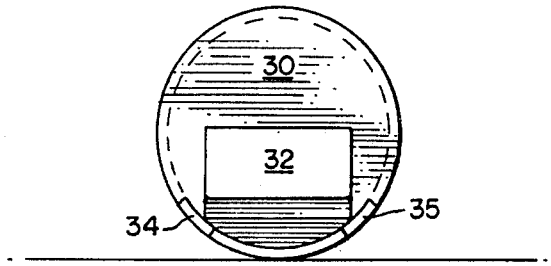
FIG. 3, is a bottom plan view of the attachment nozzle.
Figure 4:
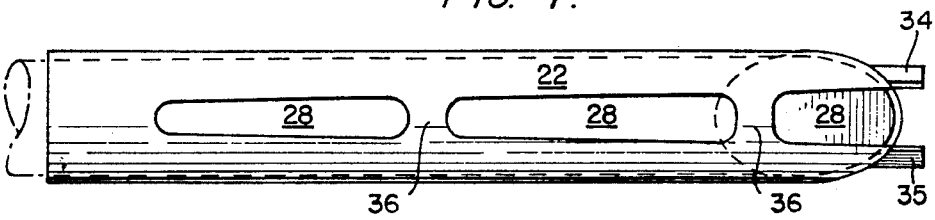
FIG. 4, is a front view of the attachment nozzle.

Attachment nozzle 20 better illustrated in FIGS. 2, 3 and 4, comprises cylindrical tube 22 having first end 24, second end 26 and longitudinally disposed slots 28. First end 24 is open and is coupled to coupling 18, as illustrated in FIG. 1. Second end 26 is closed by covering plate 30. The second end is canted as illustrated at a 45° angle so that the attachment nozzle may more easily slide under objects, for example sofas. At the base of covering plate 30 is permanent magnet 32 which is used for picking up metal objects on the surface to be cleaned. Prongs 34 and 35 comprising a prong means that extends to forward edge covering plate 30.

The attachment nozzle is formed of plastic from which is cut slots 28, canted second end 26 and prongs 34 and 35. Between the cut slots 28 remains glider or slides 36, which provides a contact surface on which the nozzle is supported during a vacuuming operation. Canted second end 26 is closed with adhesively secured covering plate 30 on which permanent magnet 32 is attached.

Figure 5:
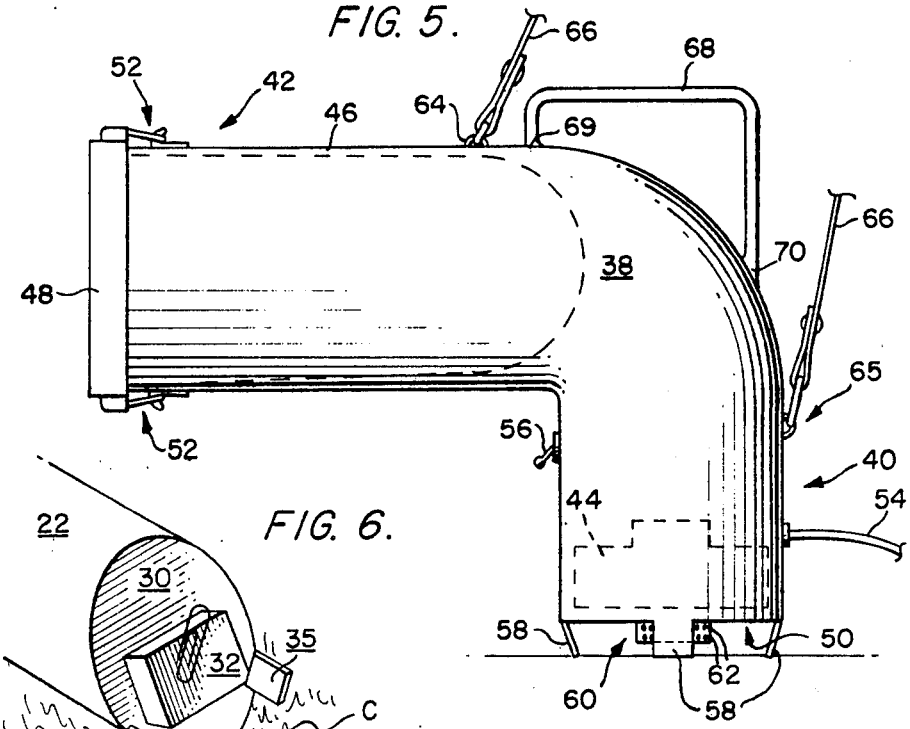
FIG. 5, is a side plan view of the vacuum cleaner.

FIG. 5 illustrates the vacuum cleaner itself which comprises elbow-shaped housing 38 having first leg 40 and second leg 42. Fitted inside of the housing is vacuum blower 44 outlined by the hidden lines, and filter bag 46 also outlined by the hidden lines. The filter bag is encased in second leg 42 of the housing which is closed by removable cover 48. Vacuum blower means 44 is encased in first leg 40 which is closed by exhaust screen 50.

Removable cover 16 is releasably secured to second leg 42 by latch means 52. The lip of the filter bag may be secured between the end of housing 38 and the removable cover. The removable cover also comprises an aperture into which the end of flexible hose 14 is frictionally fitted.

The vacuum blower means comprises an electric blower motor which is supplied electricity from any conventional outlet through electric cable 54. On/off switch 56 is used to switch the blower motor on and off as desired by the operator.

At the base of first leg 40 is exhaust screen 50. Footings 58 prevent exhaust screen 50 from resting flush against any surface which would prevent proper ventilation of the blower motor. Deodorant chamber 60 is secured against exhaust screen 50 and is provided with a series of apertures 62, from which deodorant odor or scented powder can be released.

The operator carries vacuum cleaner 10 by a carrying means which comprises ears 64 and 65 and carrying strap 66. Ear 64 is mounted on second leg 42 of housing 38 and ear 65 is mounted on first leg 40. Both ears provide mounting points for carrying strap 66. The carrying strap may be adjusted in any conventional manner to insure that cleaner 10 hangs at the proper level for the operator. In addition to the carrying strap the carrying means comprise handle 68 which is mounted to housing 38 at points 69 and 70.

A vacuum or suction is formed at attachment nozzle 20 by withdrawing air through suction tube 16 and flexible hose 14 by vacuum blower 44. Dust, dirt and other particles entrained in the air flow are trapped by disposable filter bag 46. If too many particles are trapped thereby clogging the filter bag and restricting air flow through the housing, the bag can be removed and replaced with a fresh bag.

Figure 6:
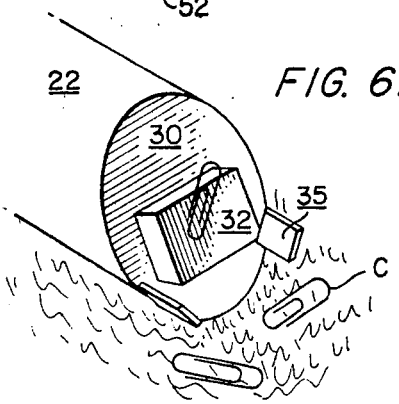
FIG. 6, is a perspective view of the front of the attachment nozzle picking up paper clips.

As already discussed vacuuming is accomplished by moving attachment nozzle 20 in a sweeping motion from side-to-side whereby dirt particles entrapped in a carpet or other surface are exposed to a suction at slots 28. Dirt particles are pulled-up into the interior of the cylindrical tube and into the vacuum. A difficult problem associated with vacuuming thick carpets in offices is paper clips, staples and other articles that get entrapped in the fibrous material of the carpet, so tightly, that simple vacuuming will not free them. The present attachment means provides a solution to this problem, by providing prongs 34 and 35 which can be used to work the paper clips and staples loose, as illustrated in FIG. 6. The operator manipulates the suction tube so that the prongs contact clips C and loosen the hold of the entrapping fibers. Permanent magnet 32 can then be used to attract and hold all metal objects so released. The manipulation of the clips by the prong means can be accomplished while the operator is standing up and therefore wasteful bending and awkward squatting is eliminated increasing operator efficiency.

Both the vacuum cleaner and the attachment means can be used independently of one another but are designed to provide peak efficiency when utilized together. So while the present invention has been disclosed in connection with the illustrated embodiments, it is not be so limited but is to be limited solely by the claims which follow:

I claim:

1. A vacuum cleaner attachment nozzle for coupling to a suction tube of a vacuum cleaner, said attachment is adapted for cleaning carpeting and other surfaces, said attachment nozzle comprising:

a tube means enclosing an interior and comprising a first end, a second end and a series of elongated slots, the first end of said tube means is open for coupling to a suction tube of a vacuum cleaner, so that the interior of said tube means communicates with the vacuum created in a suction tube of a vacuum cleaner;

the elongated slots are formed in a longitudinal direction along said tube means so that the vacuum created in the interior of said tube means by a vacuum cleaner communiates with a surface to be cleaned, the elongated slots form a suction plane for drawing material from a surface to be cleaned into said tube means; and slide means are interposed between the elongated slots to raise the suction plane formed by the longitudinal slots above the plane of the surface to be cleaned, so that an operator can easily slide said attachment nozzle along a surface to be cleaned by means of said suction tube in a side-to-side motion during the vacuuming operation.

2. A vacuum cleaner attachment nozzle in accordance with claim 1 wherein said tube means comprises a cylindrical tube.

3. A vacuum cleaner attachment nozzle in accordance with claim 2 wherein said second end of said tube means is closed by a covering plate.

4. A vacuum clener attachment nozzle in accordance with claim 3 further comprising a magnetic means which is mounted on said covering plate so that metal articles located on said surface to be cleaned can be magnetically picked up by said magnetic means.

5. A vacuum cleaner attachment nozzle in accordance with claim 4 further comprising prong means which extend outwardly from said second end of said tube means and which do not in a normal vacuuming operation come in contact with a surface to be cleaned but said prong means may be selectively used to manipulate a surface to be cleaned so that deeply entrained matter can be released therefrom.

6. A vacuum cleaner attachment nozzle in accordance with claim 6 wherein said cylindrical tube is formed from a transparent plastic so that the flow of material through said cylindrical tube can be monitored.

7. A vacuum cleaner attachment nozzle in accordance with claim 6 wherein said plurality of slots comprises three longitudinally extending slots divided by said slide means comprising two arcuate slides.

8. A vacuum cleaner attachment nozzle in accordance with claim 7 wherein said prong means comprises two prongs that are extensions of said cylindrical tube.

9. A vacuum cleaner attachment nozzle in accordance with claim 8 wherein said cylindrical tube, slide means and prongs are integrally formed from a section of plastic pipe.

10. A vacuum cleaner for cleaning surfaces, comprising a vacuum blower means for creating a vacuum, a suction tube and a nozzle assembly, wherein the vacuum created by said blower means is transmitted by said suction tube to the nozzle assembly for vacuuming a surface to be cleaned, the improvement comprising said nozzle assembly which comprises:

a tube means enclosing an interior and comprising a first end, a second end and a series of elongated slots, the first end of said tube means is open for coupling to said suction tube of said vacuum cleaner, so that the interior of said tube means communicates with the vacuum created by said blower means of said vacuum cleaner;

the elongated slots are formed in a longitudinal direction along said tube means so that the vacuum created in the interior of said tube means by said vacuum cleaner communicates with a surface to be cleaned, the elongated slots form a suction plane for drawing material from a surface to be cleaned into said tube means; and slide means are interposed between the elongated slots to raise the suction plane formed by the longitudinal slots above the plane of the surface to be cleaned, so that an operator can easily slide said nozzle assembly along a surface to be cleaned by means of said suction tube in a side-to-side motion during the vacuuming operation.

11. A vacuum cleaner in accordance with claim 10 further comprising prong means which extend outwardly from the second end of said tube means and which do not in a normal vacuuming operation come in contact with a surface to be cleaned but said prong means may be selectively used to manipulate the surface to be cleaned so that deeply entrained matter can be released therefrom.

* * * * *